US010601128B2

(12) United States Patent
Kvist et al.

(10) Patent No.: US 10,601,128 B2
(45) Date of Patent: Mar. 24, 2020

(54) DEVICE AND METHOD USING A PARASITIC ANTENNA ELEMENT TO SUBSTANTIALLY ISOLATE OR DECOUPLE FIRST AND SECOND ANTENNAS RESPECTIVELY OPERATING IN FIRST AND SECOND FREQUENCY BANDS

(75) Inventors: Søren Kvist, Vaerløse (DK); Sinasi Özden, Rodovre (DK)

(73) Assignee: GN HEARING A/S, Ballerup (DE)

( * ) Notice: Subject to any disclaimer, the term of this patent is extended or adjusted under 35 U.S.C. 154(b) by 596 days.

(21) Appl. No.: 13/229,634

(22) Filed: Sep. 9, 2011

(65) Prior Publication Data

US 2013/0017786 A1 Jan. 17, 2013

Related U.S. Application Data

(60) Provisional application No. 61/508,485, filed on Jul. 15, 2011.

(30) Foreign Application Priority Data

Jul. 15, 2011 (EP) ..... 11174155

(51) Int. Cl.
*H01Q 1/52* (2006.01)
*H01Q 1/24* (2006.01)
(Continued)

(52) U.S. Cl.
CPC ..... *H01Q 1/52* (2013.01); *H01Q 1/243* (2013.01); *H01Q 1/273* (2013.01); *H01Q 1/521* (2013.01);
(Continued)

(58) Field of Classification Search
None
See application file for complete search history.

(56) References Cited

U.S. PATENT DOCUMENTS 6,426,723 B1 * 7/2002 Smith ..... H01Q 1/22 343/700 MS
7,525,502 B2 4/2009 Hui et al.
(Continued)

FOREIGN PATENT DOCUMENTS

CN 101331650 A 12/2008
EP 2 193 767 A1 9/2010
(Continued)

OTHER PUBLICATIONS

First Japanese office action dated Sep. 17, 2013 in the corresponding JP patent application No. 2012-153679, 2 pages.
(Continued)

*Primary Examiner* — Alejandro Rivero
(74) *Attorney, Agent, or Firm* — Vista IP Law Group, LLP

(57) ABSTRACT

An antenna device includes a first antenna configured to operate within a first frequency band, a second antenna configured to operate within a second frequency band, wherein the second antenna is separated from the first antenna by a distance, and at least one parasitic antenna element, wherein the at least one parasitic element is substantially orthogonal to the first antenna, to the second antenna, or to both the first and second antennas, so as to substantially isolate between the first antenna and the second antenna.

26 Claims, 8 Drawing Sheets

(51) Int. Cl.

| | |
|---|---|
| ***H01Q 21/28*** | (2006.01) |
| ***H01Q 9/04*** | (2006.01) |
| ***H01Q 1/27*** | (2006.01) |
| ***H01Q 7/00*** | (2006.01) |

(52) U.S. Cl.
CPC ..... *H01Q 7/00* (2013.01); *H01Q 9/0421* (2013.01); *H01Q 21/28* (2013.01)

(56) References Cited

U.S. PATENT DOCUMENTS

| | | | | |
|---|---|---|---|---|
| 2004/0075613 | A1* | 4/2004 | Jarmuszewski | H01Q 1/243 343/702 |
| 2004/0137950 | A1* | 7/2004 | Bolin et al. | 455/562.1 |
| 2004/0257291 | A1* | 12/2004 | Man | H01Q 1/243 343/795 |
| 2005/0057414 | A1 | 3/2005 | Poilasne et al. | |
| 2005/0128162 | A1* | 6/2005 | Takagi | H01Q 1/243 343/895 |
| 2006/0038736 | A1* | 2/2006 | Hui et al. | 343/835 |
| 2006/0279465 | A1* | 12/2006 | Moon et al. | 343/700 MS |
| 2007/0069960 | A1* | 3/2007 | Moon et al. | 343/700 MS |
| 2009/0009400 | A1* | 1/2009 | Kim | H01Q 1/521 343/700 MS |
| 2009/0047994 | A1* | 2/2009 | Sommer et al. | 455/556.1 |
| 2009/0174611 | A1* | 7/2009 | Schlub | H01Q 1/243 343/702 |
| 2009/0186653 | A1* | 7/2009 | Drader et al. | 455/556.1 |
| 2009/0207092 | A1* | 8/2009 | Nysen | H01Q 1/2275 343/876 |
| 2009/0243944 | A1 | 10/2009 | Jung et al. | |
| 2009/0315759 | A1* | 12/2009 | Mak | G01S 3/18 342/147 |
| 2011/0215971 | A1* | 9/2011 | Rao | 343/702 |
| 2011/0298666 | A1* | 12/2011 | Kim et al. | 343/700 MS |
| 2011/0312393 | A1* | 12/2011 | Pulimi et al. | 455/575.7 |

FOREIGN PATENT DOCUMENTS

| | | | |
|---|---|---|---|
| JP | 2008-017047 | A | 1/2008 |
| JP | 4667310 | B2 | 4/2011 |
| WO | 2006 018711 | A1 | 2/2006 |
| WO | 2007/072381 | A2 | 6/2007 |
| WO | 2010 065356 | A1 | 6/2010 |
| WO | WO 2010/098529 | A1 | 9/2010 |

OTHER PUBLICATIONS

Notification of the Third Office Action dated Sep. 24, 2015, for corresponding Chinese Patent Application No. 20121246620.4, 20 pages.

* cited by examiner

DEVICE AND METHOD USING A PARASITIC ANTENNA ELEMENT TO SUBSTANTIALLY ISOLATE OR DECOUPLE FIRST AND SECOND ANTENNAS RESPECTIVELY OPERATING IN FIRST AND SECOND FREQUENCY BANDS

RELATED APPLICATION DATA

This application claims priority to and the benefit of U.S. Provisional Patent Application No. 61/508,485, filed on Jul. 15, 2011, and European Patent Application No. 11174155.9, filed on Jul. 15, 2011, the entire disclosures of all of which are expressly incorporated by reference herein.

TECHNICAL FIELD

The application generally relates to antennas, and especially to improving isolation between antennas.

BACKGROUND

Devices used for wireless communication are becoming smaller and smaller while at the same time communicating with still more wireless entities. A cell phone may for example have BLUETOOTH® connectivity, Wireless Local Area Network connectivity, FM radio connectivity, GPS functionality, etc. A hearing aid may provide connectivity not only to another hearing aid in a binaural hearing aid, but also to accessories such as cell phones, wireless remote controls, television sets, etc. The hearing aid may have connectivity to all of these entities either directly or via antenna dongles. Each of these connectivities requires an antenna for correct transmission and reception of signals. However, integrating two or more antennas in a small device typically leads to coupling between the antennas, and especially as the devices are being miniaturized.

Specifically for hearing aid users, the communication via mobile phones may be difficult due to interference between the mobile phone and the digital hearing aid. Therefore, it has been suggested that a hearing aid user uses the mobile phone without the hearing aid and with e.g. the volume control setting of a handset being at maximum value. Another solution has been suggested in which the mobile phone is inductively connected to the hearing aid, e.g. via a so-called Telecoil or T-link.

To ease the communication, one straightforward solution could be to place a Bluetooth receiver directly in the hearing aid for communication with a Bluetooth element in the mobile phone. However, it is not feasible to place a Bluetooth transceiver directly in the hearing aid device, as a Bluetooth transceiver would deplete the hearing aid battery too fast. It has therefore been suggested to use a Bluetooth bridging device having a proximity antenna for communicating with the hearing aid and a Bluetooth antenna for communicating with the Bluetooth transceiver in the mobile phone. However, as the proximity antenna and the Bluetooth antenna operate at the same frequency, i.e. around 2.4 GHz, strong interference between the proximity antenna and the Bluetooth antenna have been reported influencing both the signal quality and the connectivity.

Thus, for isolation among the antennas, antenna design and antenna placement in devices are becoming a still more important design factor. For closely spaced antennas configured to operate at different frequencies, the use of wavelength filters for reducing coupling has been suggested.

However, such filters, typically LC filters, takes up too much space and tend to reduce bandwidth and efficiency for the antenna.

Also, for closely spaced antennas provided at a common printed circuit board, one or more slits in the printed circuit board have been suggested for providing isolation between the antennas. However, the efficiency of such a slit is often reduced by providing other conductors across the slit for connecting components on the printed circuit board on either side of the slit. Furthermore, providing a slit in the ground plane also reduces the effective ground plane for each antenna, thus reducing the antenna Q value.

SUMMARY

It is therefore an object to provide an antenna device for facilitating improved isolation between two or more antennas.

According to a first aspect of one or more embodiments, an antenna device is provided, the antenna device comprising a first antenna configured to operate within a first frequency band, a second antenna configured to operate within a second frequency band separated by a distance to the first antenna, and at least one parasitic antenna element. The at least one parasitic element may be provided substantially orthogonally to the first and/or second antenna so as to substantially isolate between the first antenna and the second antenna.

According to another aspect of one or more embodiments, an antenna device is provided comprising a first antenna, a second antenna, and at least one parasitic antenna element. The first antenna being configured to operate within a first frequency band and provided at a supporting structure and the second antenna being configured to operate within a second frequency band and provided at the supporting structure separated by a distance to the first antenna. The at least one parasitic element may be configured to draw electromagnetically induced current in the supporting structure between the first antenna and the at least one parasitic antenna element in a first direction and configured to draw electromagnetically induced current in the supporting structure between the second antenna and the parasitic antenna element in a second direction, the first and second directions being substantially orthogonal.

According to a further aspect of one or more embodiments, a method of decoupling between closely spaced first and second antennas is provided, the first antenna being configured to operate within a first frequency band, and the second antenna being configured to operate within second frequency band. The method comprises decoupling the first and second antennas via a parasitic antenna element provided substantially orthogonal to the first antenna and/or the second antenna.

According to yet another aspect of one or more embodiments, a coupling device facilitating communication between a hearing aid and a communication device is provided, the coupling device comprises a first antenna configured to communicate with the hearing aid, a second antenna configured to communicate with the communication device, and at least one parasitic antenna element. The at least one parasitic element may be provided substantially orthogonally to the first and/or second antenna so as to substantially isolate between the first antenna and the second antenna.

The first antenna and the second antenna may be provided at a supporting structure, and separated by a distance. The at least one parasitic element may be provided at the supporting structure and being configured to draw electromagnetically induced current in the substrate structure between the first antenna and the at least one parasitic antenna element in a first direction and configured to draw electromagnetically induced current in the supporting structure between the second antenna and the parasitic antenna element in a second direction, the first and second directions being substantially orthogonal. The first antenna and the second antenna may be configured to operate within a first and a second frequency band, respectively. The first antenna and the second antenna may be closely spaced, such as positioned within a distance of a full wavelength of a main operating frequency for at least one of the antennas, such as within a distance of a half wavelength.

The first and second frequency bands may be separate frequency bands, such that for example, the first antenna may be configured to operate within the UMTS frequency ranges or the GSM frequency ranges, such as around 2.1 GHz, whereas the second antenna may be configured to communicate using the Bluetooth standard and, thus, a frequency range around 2.4 GHz. The first and second frequency bands may also be at least overlapping, so that the bandwidth of the first antenna at least overlaps with the bandwidth of a second antenna. Furthermore, the first antenna and the second antenna may be configured to operate substantially at a same frequency.

For example, the first antenna may be an antenna configured to communicate using the Bluetooth standard, and thus a frequency range around 2.4 GHz, and the second antenna may be an antenna configured to operate using a protocol different from the Bluetooth standard, but around substantially the same frequency, such as around of 2.4 GHz. As 2.4 GHz is an un-licensed frequency typically used for communication, this may be experienced when one device is communicating wirelessly with more communication devices, such as using two different WLAN standards, e.g. Bluetooth and any other WLAN standard.

In a preferred embodiment, the first antenna is a proximity antenna configured for communicating with a hearing aid, using a proximity antenna protocol, and the second antenna is an antenna configured to communicating using the Bluetooth standard. It is an advantage of using a proximity antenna protocol for communicating with the hearing aid in that the proximity antenna protocol may be specifically designed for communication with the hearing aid. Typically, not all data packages received by the Bluetooth antenna are transmitted to the hearing aid, and furthermore, the protocol may be designed so as to minimize e.g. handshakes and control signals transmitted from a hearing aid transceiver to a proximity antenna transceiver to reduce hearing aid power consumption. Typically, each hearing aid manufacturer provides a tailored proximity antenna protocol, and it is envisaged that any protocol may be used by the proximity antenna, the protocol generally being implemented by a central processing unit.

Size matters, and for e.g. laptops the first and second antennas may be provided in adequate distance from each other, however, for smaller devices, it is advantageous to provide isolation among the antennas.

In some embodiments, the first antenna and the second antenna are closely spaced, such as provided substantially within a full wavelength, such as within a half wavelength of each other, such as spaced apart by a full wavelength, three quarter wavelength, five eights wavelength of a half wavelength of a main operating frequency for one of the first and/or second antennas.

To provide isolation among the first antenna and the second antenna, the parasitic antenna element is preferably positioned substantially orthogonally to the first and/or second antennas. In one embodiment, the first antenna and/or the second antenna is provided in the same plane as the parasitic antenna element, such as provided at one or more substrates in a same plane. The parasitic antenna element is a passive antenna element which receives power from a surrounding electromagnetic field and is not fed actively e.g. via a feed line, as actively excited antennas are. The parasitic element typically comprises a conducting material.

The parasitic antenna element may have a polarization which is orthogonal to the polarization of the first antenna and/or the second antenna, such as having a polarization which is orthogonal at least when the antennas are placed in a same plane. Orthogonal polarization includes the combinations of horizontal/vertical polarization, ±slant 45° polarization, left-hand/right-hand circular polarization, etc. In a preferred embodiment, the first antenna polarization and the second antenna polarization are substantially the same, at least when they are placed in a same plane, or having a common ground plane.

Furthermore, the parasitic antenna element may, upon excitation, have a radiation pattern which is rotated substantially 90° with respect to the radiation pattern for at least one of the first antenna and the second antenna.

At least one of the first antenna and the second antenna may have a longitudinal axis, and the parasitic antenna element may have a longitudinal direction being substantially orthogonal to the longitudinal axis of the at least one of the first antenna and the second antenna. In a preferred embodiment, one of the first antenna and the second antenna comprises a pifa-antenna, and the parasitic antenna element is positioned substantially orthogonal to the pifa-antenna.

Preferably, the parasitic antenna element has a length of a quarter wavelength of a main operating frequency for at least one of the first and second antennas, such a length of substantially a quarter of 2.4 GHz, corresponding to a length of about 31.25 mm. However, the length of the parasitic antenna element may also be between one eights wavelength and five eights wavelength of the main operation frequency, such as between three eights wavelength and five eights wavelength of the main operating frequency for at least one of the first and second antennas.

It is an advantage of providing a parasitic antenna element orthogonally to the closely spaced first antenna and second antenna that isolation between the first and second antenna is obtained.

It is envisaged that the device may comprise more antennas, such that one antenna may comprise more antenna elements, such as to obtain e.g. antenna diversity. Also, the antenna device may include more antennas, such as a third antenna orthogonal to the first antenna and/or the second antenna and the parasitic antenna element, such as an antenna being orthogonal the plane comprising the first antenna, the second antenna and the parasitic antenna element.

Miniaturizing the devices also includes the miniaturization of the antenna foot prints which in turn leads to lower efficiency and bandwidth for the antenna. It has been found that providing a parasitic antenna element in close proximity to an antenna, such as a Bluetooth antenna, may increase the bandwidth and/or power of the antenna signal. Preferably, the parasitic antenna element is provided in close proximity to the antenna, such as within a quarter wavelength, such as within one eights wavelength, such as within one sixteenth wavelength, such as at a distance of one sixteenth wavelength of a main operating frequency of the antenna. Preferably, the parasitic antenna element is an elongated parasitic element, such as an elongated parasitic antenna element provided in continuation of the radiation pattern of one of the first and second antennas.

The first antenna, the second antenna and the parasitic antenna element may have a common ground potential, such as a common ground plane. The common ground plane may be a conducting ground plane, such as a printed circuit board. The common ground plane may additionally or alternatively be a reflecting plane. It is preferred to provide the first antenna, the second antenna and/or the parasitic antenna element so that the ground plane is placed substantially on one side of the radiating element. The first antenna, the second antenna and the parasitic antenna element(s) may be provided at one or more supporting structures, such as at one or more printed circuit boards. Preferably, the first antenna and/or the second antenna, such as at least one of the first antenna and the second antenna, has a feeding point in close proximity to an edge of the respective supporting structure and/or are positioned in close proximity to an edge of the respective supporting structure, such as within one sixteenth wavelength, such as within one eight wavelength, such as within a quarter wavelength of the main operating frequency for the first antenna and/or the second antenna from the edge.

Even though reference in the following is made to a supporting structure, it is envisaged that the antenna elements may be positioned at separate supporting structures, the separate supporting structures and/or the antennas thereat being configured to be operationally interconnected.

The supporting structure may be an electrically conducting structure and may form a ground plane and/or a reflecting plane for the first antenna, the second antenna and/or the parasitic antenna element. In a preferred embodiment, the ground plane is a substantially rectangular ground plane.

In other embodiments, the at least one parasitic element is configured to draw electromagnetically induced current in the supporting structure between the first antenna and the at least one parasitic antenna element in a first direction and configured to draw electromagnetically induced current in the supporting structure between the second antenna and the parasitic antenna element in a second direction, the first and second directions being substantially orthogonal.

Hereby, the current induced in the supporting structure by the first antenna is at least substantially orthogonal to current induced in the supporting structure by the second antenna thereby isolating the first antenna from the second antenna and vice versa. By isolating among the first antenna and the second antenna, the coupling between the antennas is considerably reduced, and the correlation coefficient may approximate zero. Thus, in this configuration the antennas may have low coupling and high isolation.

The at least one parasitic antenna element may protrude from the supporting structure, preferably, the parasitic antenna element is lifted from the plane of the first antenna and/or the second antenna, for example such that the conducting part of the parasitic antenna element is provided on an elevated structure. By having the at least one parasitic antenna element protruding from the supporting structure, the capacitance may be lowered and an improved radiation pattern may be obtained.

The antenna device comprising the first antenna, the second antenna and the at least one parasitic antenna element may be accommodated in a housing. In one embodiment, the housing accommodating the antenna device has a length longer than a half wavelength but shorter than a full wavelength, such as a length between a half wavelength and five eights wavelength of the main operating frequency. The width of the housing may be shorter than a half wavelength of a main operating frequency for at least one of the first antenna and the second antenna, such as between a quarter wavelength and a half wavelength, such as between a quarter wavelength and five sixteenth wavelength of a main operating frequency. Thus, in a preferred embodiment, wherein at least one of the first antenna and the second antenna is configured to operate at a main operating frequency of 2.4 GHz, the housing may have a length of between 70 mm and 80 mm, and a width of between 31 mm and 39 mm. The supporting structure forming a ground plane for the antennas may have corresponding dimensions.

A main operating frequency as herein described may also be a frequency calculated on the basis of the main operating frequency, or a carrier frequency, for the at least first antenna and second antenna, such as a mean value of the carrier frequencies, etc.

One layout of the antennas on the one or more supporting structures forming a ground plane for the antennas may comprise a layout wherein the first antenna may be provided along and connected to the ground plane at or along a first edge of the supporting structure and the second antenna may be provided along and connected to the ground plane at or along the same first edge spaced from the first antenna by a distance so as to provide for two closely spaced antennas as described above.

The parasitic antenna element may be provided along a second edge of the supporting substrate, the first and second edge being in a same plane, and the second edge being substantially orthogonal to the first edge.

The supporting substrate may be an elongated plane substrate and the first antenna may be provided along a first longitudinal side of the elongated substrate, the second antenna may be provided along the same longitudinal side separated from the first antenna by a distance, the second antenna being adjacent a corner of the elongated substrate, and the parasitic antenna element is provided along a transversal side of the elongated substrate adjacent the corner.

The second antenna may be provided so as to have a radiation pattern in the ground plane primarily in the second direction along a propagation axis, and the parasitic antenna element may be configured to radiate primarily in the second direction along said propagation axis. Preferably, the parasitic antenna element is a quarter wavelength parasitic element being positioned with its longitudinal direction along said propagation axis in the second direction.

The second antenna and the parasitic element thus being configured to enhance the radiation efficiency of the second antenna and/or to enhance the quality factor, Q factor, for the second antenna.

In one embodiment, the first antenna may be a monopole antenna, such as a wire monopole, such as a pifa antenna, such as a monopole antenna where the top section has been folded down so as to be parallel with a ground plane, the antenna may be an on ground sheet metal on plastic. The first antenna may preferably be a $\lambda/4$ element. The first antenna is preferably configured to communicate with a hearing aid. The first antenna may be located above the ground plane. The parasitic antenna element may any parasitic antenna element, such as preferably a quarter wavelength element, such as a quarter wavelength antenna element being an on ground sheet metal on plastic. The second antenna may be any antenna, such as any conventional commercially available antenna, such as a loop antenna, preferably a ceramic chip antenna, such as an SMD antenna, such as preferably a Bluetooth compatible antenna.

The first antenna may be provided on a protruding element, and connected to ground via a conductor on the protruding element. The protruding element may have height of approximately one sixteenth of a wavelength, such as between one eighteenth wavelength and one eight wavelength. The first antenna may be configured to draw a current via the conductor on the protruding element in a direction substantially orthogonal to the supporting structure during operation.

The antenna device may further comprise a first transceiver and a second transceiver structured to be connected to the first antenna and the second antenna, respectively. The first antenna may be configured to receive and transmit using a first protocol and the second antenna may be configured to receive and transmit using a second protocol. The first protocol and/or the second protocol may be implemented in an antenna assembly, or first protocol and/or the second protocol may be controlled by a central processing unit in the antenna device. The antenna protocols may be any antenna protocols such as any WLAN protocol, such as TCP/IP, PPPoP, PPTP, such as Bluetooth, such as any specifically tailored antenna protocol, etc.

Furthermore, the antenna may comprise a first electrical circuit structured to be electrically coupled to the first antenna, and a second electrical circuit structured to be electrically coupled to the second antenna, wherein the first and second electrical circuits are structured to be electrically connected so that information received by the second antenna from the communication device using for example the Bluetooth protocol, is provided to the second electrical circuit and transferred to the first electrical circuit for transmission via for example the proximity protocol to the hearing aid via the first antenna. The information received by the second electrical circuit may be transmitted to the first electrical circuit via a central processing unit, and vice versa. The central processing unit may transform or adapt the information received via the second antenna protocol to a format being transmittable via the first antenna protocol and vice versa. Furthermore, the central processing unit may transmit and receive further signals, such as signals for controlling the communication.

In accordance with some embodiments, an antenna device includes a first antenna configured to operate within a first frequency band, a second antenna configured to operate within a second frequency band, wherein the second antenna is separated from the first antenna by a distance, and at least one parasitic antenna element, wherein the at least one parasitic element is substantially orthogonal to the first antenna, to the second antenna, or to both the first and second antennas, so as to substantially isolate between the first antenna and the second antenna.

In accordance with other embodiments, a method of decoupling between closely spaced first and second antennas, the first antenna being configured to operate within a first frequency band, and the second antenna being configured to operate within a second frequency band, the method comprising decoupling the first and second antennas via a parasitic antenna element that is substantially orthogonal to the first antenna, to the second antenna, or to both the first and second antennas.

In accordance with other embodiments, a coupling device facilitating communication between a hearing aid and a communication device includes a first antenna configured to communicate with the hearing aid, a second antenna configured to communicate with the communication device, and at least one parasitic antenna element, wherein the at least one parasitic element is substantially orthogonally to the first antenna, to the second antenna, or to both the first and second antennas, so as to substantially isolate between the first antenna and the second antenna.

Other and further aspects and features will be evident from reading the following detailed description of the embodiments.

BRIEF DESCRIPTION OF THE FIGURES

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1:
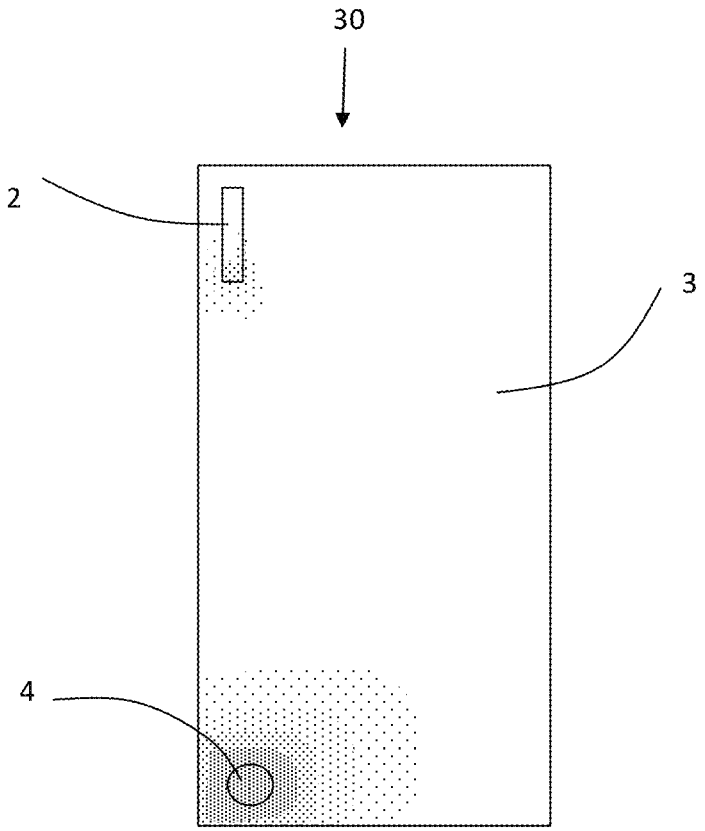
Fig. 1 (prior art)
FIG. 1 shows schematically the radiation pattern from a loop antenna at a prior art antenna device.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

Figure 2:
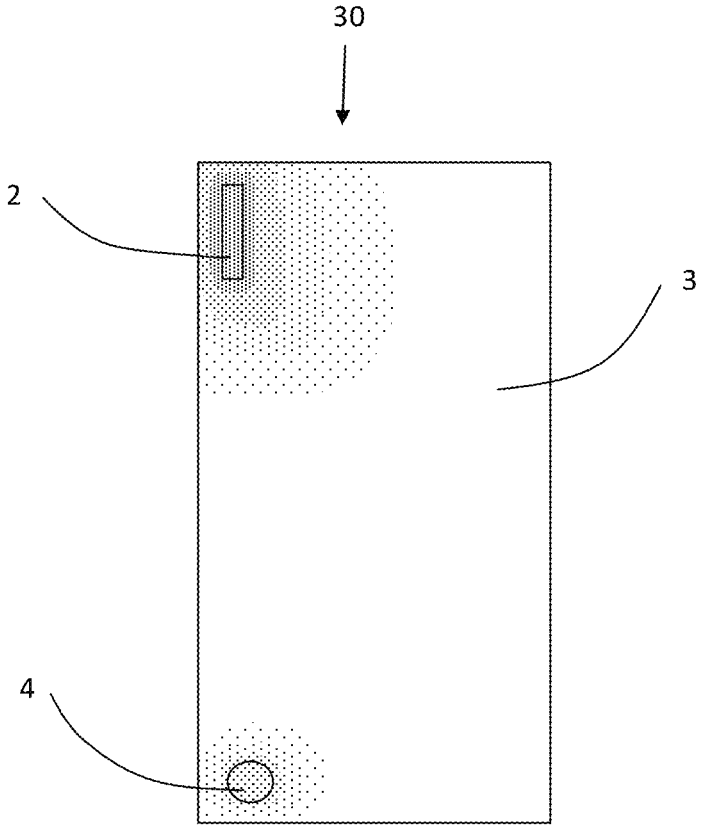
Fig. 2 (prior art)
FIG. 2 shows schematically the radiation pattern from a monopole antenna at a prior art antenna device.

In FIG. 1, a prior art antenna device 30 is shown comprising a monopole antenna 2 and a loop antenna 4 being closely spaced and positioned on a supporting structure 3, such a printed circuit board. In FIG. 1, only the loop antenna 4 is actively excited and the radiation pattern is shown with dots. The closer the dots are placed, the higher is the power of the radiated field. It is clearly seen that even though only the loop antenna is actively excited, an electromagnetic field is also formed around the monopole antenna 2. In FIG. 2, a same prior art antenna device 30 is shown comprising a monopole antenna 2 and a loop antenna 4. In FIG. 2, only the monopole antenna 2 is actively excited, and the radiation pattern is shown with dots. The closer the dots are placed, the higher is the power of the radiated field. It is clearly seen that even though only the monopole antenna 2 is actively excited, an electromagnetic field is also formed around the loop antenna 4.

Figure 3:
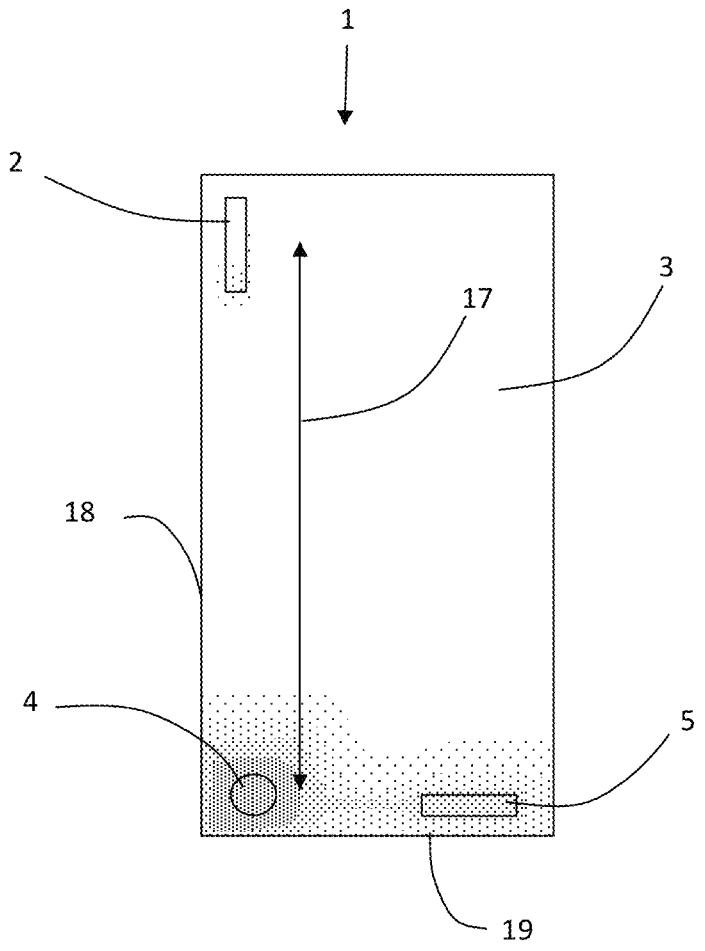
FIG. 3 shows schematically a radiation pattern from a loop antenna when the antenna device comprises a parasitic antenna element.

FIG. 3 shows an antenna device 1 according to some embodiments comprising a first antenna 2, a second antenna 4 and a parasitic antenna element 5. The first antenna 2, the second antenna, 4 and the parasitic antenna element 5 are positioned on a supporting substrate 3. In FIG. 3, the first antenna 2 is shown as monopole antenna and the second antenna 4 is shown as a loop antenna. However, it is envisaged that the first antenna and the second antenna may be any antenna elements, including but not limited to patch antennas, monopole antennas, such as pifa antennas, dipole antennas, etc. The first antenna is configured to operate within a first frequency band, and the second antenna is configured to operate within a second frequency band. In a preferred embodiment at least one of the first and second antennas has a carrier frequency around 2.4 GHz, but the carrier frequency, or main operating frequency, may be selected in the entire frequency band. The first antenna and the second antenna are separated by a distance 17 (centre-to-centre). The first antenna and the second antenna may be positioned within a distance 17 of a full wavelength of a main operating frequency for at least one of the antennas, such as within a distance of a half wavelength. In the present example, the distance is approximately 62.5 mm.

The first antenna 2 and the second antenna 4 may provided along a same axis, such as along a first edge 18 of the supporting substrate 3, or they may be provided at an angle to each other different from 0° or 180°, such as at an angle of between 0° and 45°, such as between 180°±45°, or any multiple thereof. Preferably, the angle is substantially 0° or substantially 180°. Thus, the polarisation of the first antenna 2 and the second antenna 4 may be substantially the same, or the angle between the polarisation of the first antenna polarisation and the second antenna polarisation may be between 0° and ±45°. The at least one parasitic element 5 may be provided substantially orthogonally to the first and/or second antenna 2, 4 so as to substantially isolate between the first antenna 2 and the second antenna 4. The parasitic antenna element 5 may be any parasitic antenna element, preferably such as a longitudinal parasitic antenna element, and even more preferred such as a $\lambda/4$ parasitic antenna element. In FIG. 3, it is seen that the parasitic antenna element 5 is positioned substantially along a second edge 19 of the rectangular supporting substrate 3. The second edge 19 is seen to be substantially orthogonal to the first edge 18. However, it is also envisaged that the supporting substrate 3 may have any other shape, such as a parallelogram, a trapezoid or any other shape suitable for forming a ground plane for one or more of the antennas 2, 4 or parasitic antenna element(s) 5. For the antennas and the parasitic antenna element(s) to achieve an optimum coupling to the supporting substrate 3, such as the PCB, the antennas and parasitic antenna element(s) are preferably positioned adjacent an edge of the supporting substrate. However, even though not shown specifically in the drawings, the antennas and the parasitic antenna elements may be positioned anywhere, such as anywhere on the supporting substrate.

In FIG. 3, only the second antenna 4 is actively excited, and it is seen that the second antenna induces an electromagnetic field at the parasitic antenna element 5. However, it is also seen that the coupling to the first antenna 2 is significantly reduced.

Figure 4:
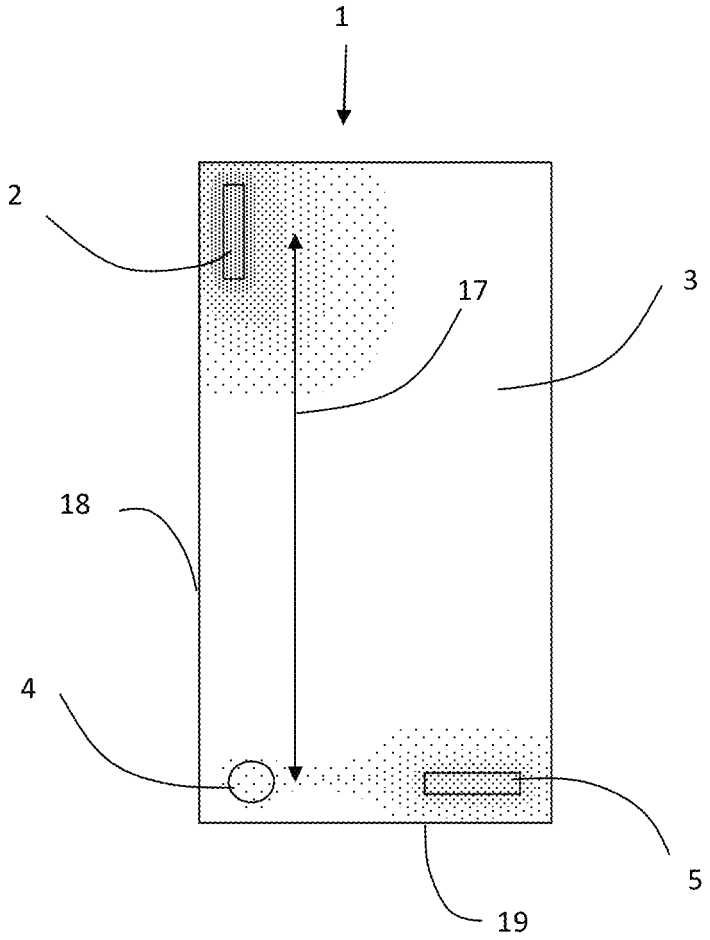
FIG. 4 shows schematically a radiation pattern from a monopole antenna when the antenna device comprises a parasitic antenna element.

In FIG. 4, the same antenna device as shown in FIG. 3 is shown, however, in FIG. 4 only the first antenna 2 is actively excited. It is seen that an electromagnetic field is induced around the first antenna 2, and additionally at the parasitic antenna element 5, whereas only a weak coupling to the second antenna 4 is seen.

Figure 5:
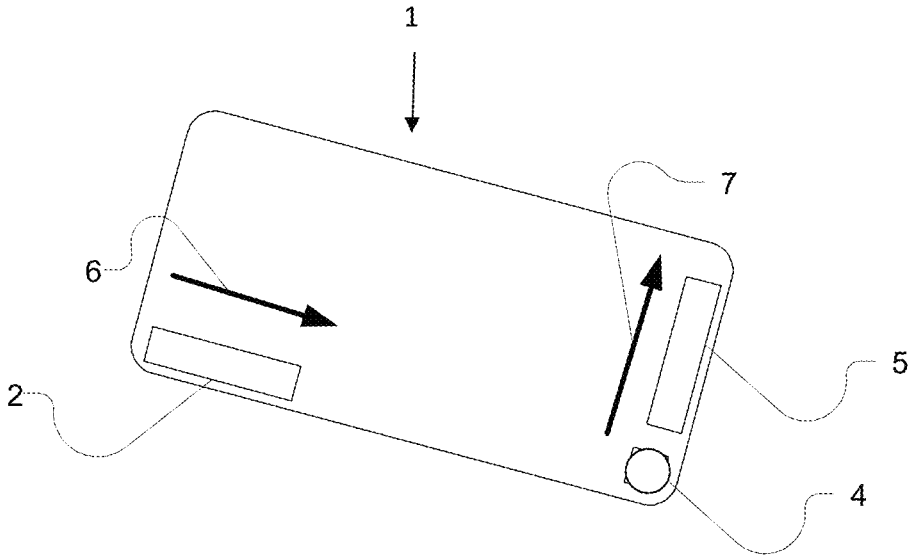
FIG. 5 shows schematically the current direction for a monopole and a loop antenna at an antenna device.

FIG. 5 shows an antenna device wherein the main current directions upon excitation are shown. The first antenna 2 and the second antenna 4 are configured so that when the first antenna and the second antenna are excited, the at least one parasitic element 5 is configured to draw electromagnetically induced current in the supporting structure 3 between the first antenna 2 and the at least one parasitic antenna element 5 in a first direction 6 and configured to draw electromagnetically induced current in the supporting structure 3 between the second antenna 4 and the parasitic antenna element 5 in a second direction 7, the first and second directions being substantially orthogonal. Thus, the parasitic antenna element 5 being positioned substantially orthogonal to at least the first antenna 2 draws a current in a direction from the first antenna 2 towards the parasitic antenna element 5. The parasitic antenna element furthermore draws a current from the second antenna element 4, in a direction 7 being substantially orthogonal to the first direction 6. Thereby, the coupling between the first antenna 2 and the second antenna 4 is significantly reduced.

Figure 6:
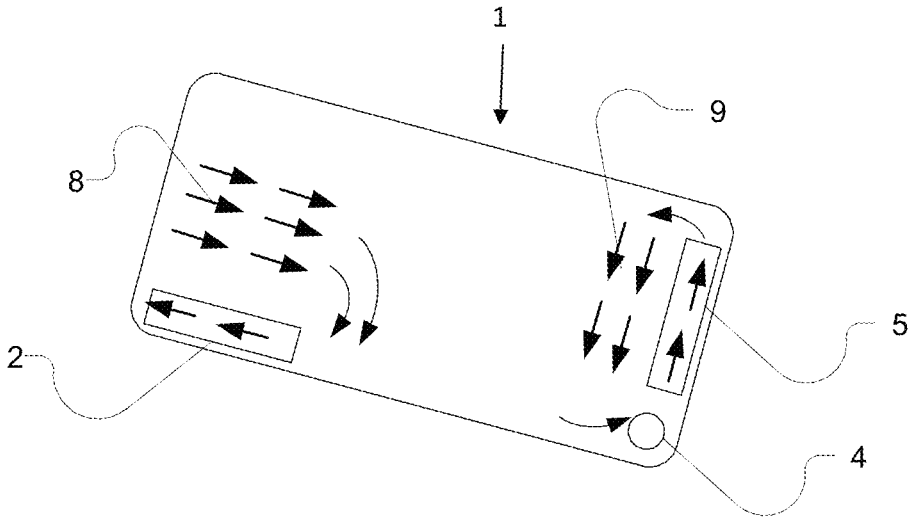
FIG. 6 shows schematically the current distribution for a monopole and a loop antenna provided at an antenna device.

In FIG. 6, an approximate current distribution for current induced in the supporting structure 3 upon excitation of the first antenna 2 and the second antenna 4, in and around the first antenna 2, the second antenna 4 and the parasitic antenna element 5 is shown schematically, and it is seen that the main current components 8, 9 run along the directions 6 and 7 as shown in FIG. 5.

Figure 7:
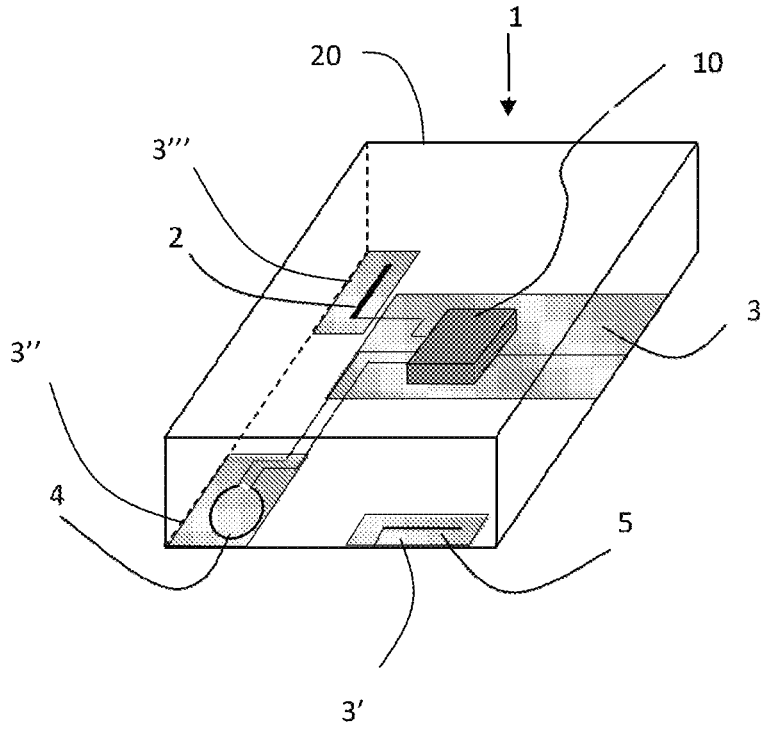
FIG. 7 shows the first antenna, the second antenna and the parasitic antenna elements distributed at different supporting substrates.

FIG. 7 shows another antenna device 1, wherein each antenna element 2, 4, 5 has a separate supporting substrate 3. It is envisaged that the first antenna 2, the second antenna 4 and the parasitic antenna element 5 may be positioned at different supporting structures 3, 3', 3", 3'", and may be provided detachable to each other. The supporting substrates 3, 3', 3", 3'" may preferably have a common ground potential, however, the supporting substrates 3, 3', 3", 3'" may have different relative ground potentials.

The antenna device 1 may further comprise a first electrical circuit structured to be electrically coupled to the first antenna 2, and a second electrical circuit structured to be electrically coupled to the second antenna 4, wherein the first and second electrical circuits are structured to be electrically connected so that information received by the second antenna 4 is provided to the second electrical circuit and transferred to the first electrical circuit for transmission via the first antenna 2. The information received by the second electrical circuit may be transmitted to the first electrical circuit via a central processing unit 10, and vice versa. In FIG. 7, only the conductors to and from the CPU 10 are shown. The central processing unit 10 may transform or adapt the information received via the second antenna protocol to a format being transmittable via the first antenna protocol and vice versa.

Furthermore, the central processing unit 10 may transmit and receive further signals, such as signals for controlling the communication. The antenna device 1 in FIG. 7 is accommodated within a housing 20.

Figure 8:
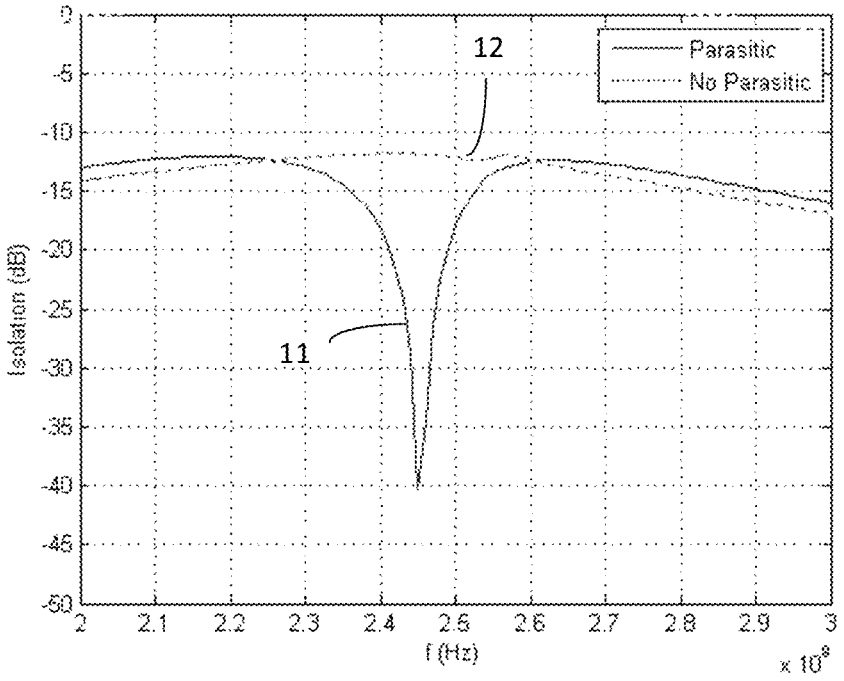
FIG. 8 is a diagram showing the isolation as a function of frequency between two antennas for an antenna device with and without a parasitic antenna element.

FIG. 8 shows the isolation between the first antenna 2 and the second antenna 4 as a function of frequency with and without a parasitic antenna element 5 present. In the present example, the first antenna and the second antenna are configured for radiation of an electromagnetic field of approximately 2.4 GHz, and the parasitic antenna element 5 is tuned so as to obtain a low coupling efficiency, i.e. a good isolation at 2.4 GHz. The curve 12 shows the isolation as a function of frequency in an antenna device wherein there is no parasitic antenna element present, and no improved isolation is seen around 2.4 GHz. The curve 11 shows the isolation as a function of frequency in an antenna device 1 wherein a parasitic antenna element 5 is present, and preferably positioned substantially orthogonally to the first 2 and/or second 4 antenna so as to substantially isolate between the first antenna 2 and the second antenna 4. As seen from the curve 11, the isolation is significantly improved around 2.4 GHz, thus a low coupling between the first and second antennas is achieved.

Figure 9:
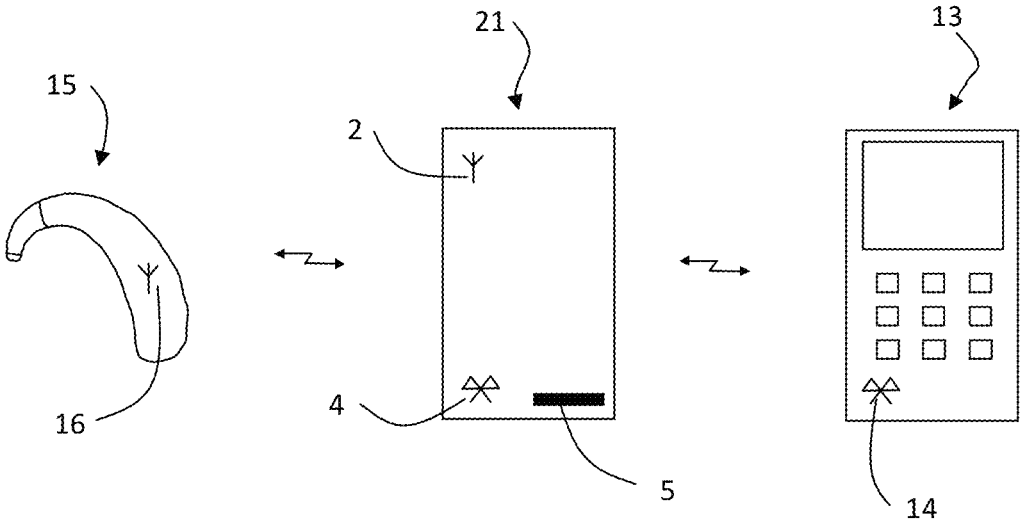
FIG. 9 illustrates a coupling device for coupling between a hearing aid and a communication device.

In FIG. 9, a coupling device 21 according to some embodiments is shown. The coupling device 21 provides for coupling between a communication device 13, such as a mobile phone, and a hearing aid 15. The coupling device 21 comprises a first antenna 2 configured to communicate with the hearing aid 15, a second antenna 4 configured to communicate with the communication device 13, and at least one parasitic antenna element 5. The at least one parasitic element is provided substantially orthogonally to the first and/or second antenna so as to substantially isolate between the first antenna and the second antenna.

It is an advantage of providing a coupling device capable of controlling the connection between the hearing aid and any external device connectable to the hearing aid via the coupling device that an optimum coupling is ensured. This could be connections to any external devices, such as communication devices, computers, such as laptops, television sets, hearing aid fitting instruments, etc. For hearing aid users, it has been a problem that communication via mobile phones has been difficult and unreliable, as more and more telecommunication is performed using mobile phones. It is therefore a significant advantage of the coupling device that it allows hearing aid users to use mobile phones via the coupling device and a standard Bluetooth interface.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A coupling device facilitating communication between a hearing device and a communication device, the coupling device having an antenna device, the antenna device comprising:

a first antenna having a first polarization and configured to operate within a first frequency band;

a second antenna having a second polarization and configured to operate within a second frequency band, wherein the second antenna is separated from the first antenna; and at least one parasitic antenna element;

wherein the at least one parasitic antenna element has a third polarization, the at least one parasitic antenna element configured to provide some isolation between the first antenna and the second antenna;

wherein the coupling device further comprises a supporting structure having a first surface and a second surface that is opposite from the first surface;

wherein the supporting structure comprises an elongated substrate, the supporting structure having a first side, a second side shorter than the first side, a third side opposite from the first side, and a fourth side opposite from the second side;

wherein the supporting structure comprises a ground plane and the first antenna is connected to the ground plane;

wherein the first antenna, the second antenna, and the at least one parasitic antenna element are coupled to the supporting structure;

wherein (1) an entirety of the at least one parasitic antenna element, and (2) the second antenna, are both closer to the second side than to the fourth side, wherein the first antenna is closer to the fourth side than to the second side, wherein the at least one parasitic antenna element is closer to the first side than to the third side, and wherein the second antenna is closer to the third side than to the first side;

wherein the at least one parasitic antenna element is located closer to the second antenna than to the first antenna; and wherein a direction of the third polarization is different from a direction of the first polarization, and is also different from a direction of the second polarization.

2. The coupling device according to claim 1, wherein the first and second frequency bands are at least overlapping.

3. The coupling device according to claim 1, wherein the first and second antennas are configured to operate at a same frequency.

4. The coupling device according to claim 1, wherein the at least one parasitic antenna element has a length of a quarter wavelength of a main operating frequency for at least one of the first and second antennas.

5. The coupling device according to claim 1, wherein the first antenna is a proximity antenna configured to communicate with the hearing device, and the second antenna is a Bluetooth or wireless local area network antenna.

6. The coupling device according to claim 1, wherein a distance between the first antenna and the second antenna is between a half wavelength and a full wavelength of a main operating frequency of the first antenna or the second antenna.

7. The coupling device according to claim 1, wherein the support structure comprises one or more supporting components.

8. The coupling device according to claim 1, wherein the supporting structure comprises a printed circuit board.

9. The coupling device according to claim 1, wherein the supporting structure further comprises a reflecting plane.

10. The coupling device according to claim 1, wherein the at least one parasitic antenna element is configured to draw electromagnetically induced current in the supporting structure between the first antenna and the at least one parasitic antenna element in a first direction, and is configured to draw electromagnetically induced current in the supporting structure between the second antenna and the at least one parasitic antenna element in a second direction that is different from the first direction.

11. The coupling device of claim 10, wherein the first and second directions are orthogonal.

12. The coupling device according to claim 1, wherein the at least one parasitic antenna element protrudes from the supporting structure.

13. The coupling device according to claim 1, wherein the first antenna is a planar inverted-F antenna (PIFA) on a protruding element, and is connected to the ground plane via a conductor on the protruding element.

14. The coupling device according to claim 1, wherein the first antenna is located along and connected to the ground plane at a first edge of the supporting structure, and the second antenna is provided along and connected to the ground plane at the same first edge.

15. The coupling device according to claim 14, wherein the at least one parasitic antenna element is located along a second edge of the supporting structure, the first and second edges being in a same plane, and the second edge being orthogonal to the first edge.

16. The coupling device according to claim 1, wherein the first antenna has a long side that directionally corresponds with the first side of the elongated substrate.

17. The coupling device according to claim 16, wherein the long side of the first antenna forms an angle with respect to the first side of the elongated substrate, the angle being less than 90°.

18. The coupling device according to claim 1, wherein the second antenna has a shape that is different from the first antenna.

19. The coupling device according to claim 1, wherein the first antenna is electrically connected to the ground plane.

20. The coupling device according to claim 1, wherein the entirety of the at least one parasitic antenna element is located away from all space that is between the first antenna and the second antenna.

21. The coupling device according to claim 1, wherein the at least one parasitic antenna element and the first antenna are separated by a spacing, wherein the entirety of the at least one parasitic antenna element and an entirety of the first antenna are on opposite sides of the spacing, and wherein the at least one parasitic antenna element, the first antenna, and the spacing are at different respective longitudinal positions with respect to a longitudinal axis of the elongated substrate.

22. The coupling device according to claim 1, wherein a major length of the at least one parasitic antenna element is longer than a major length of the second antenna.

23. A coupling device facilitating communication between a hearing aid and a communication device, the coupling device comprising:

a first antenna having a first polarization and configured to communicate with the hearing aid;

a second antenna having a second polarization and configured to communicate with the communication device; and at least one parasitic antenna element, wherein the at least one parasitic element has a third polarization, the at least one parasitic element configured to provide some isolation between the first antenna and the second antenna;

wherein the first antenna, the second antenna, and the at least one parasitic antenna element are coupled to a supporting structure, the supporting structure having a first surface and a second surface opposite from the first surface, wherein the supporting structure comprises an elongated substrate, wherein the supporting structure comprises a ground plane and the first antenna is connected to the ground plane;

wherein a major length of the at least one parasitic antenna element is longer than a major length of the second antenna;

wherein an entirety of the first antenna is located closer to a first long side of the elongated substrate than to a second long side of the elongated substrate, and wherein the at least one parasitic antenna element is located closer to the second long side of the elongated substrate than to the first long side of the elongated substrate;

wherein an entirety of one of the at least one parasitic antenna element is located closer to a first short side of the elongated substrate than to a second short side of the elongated substrate; and wherein a direction of the third polarization is different from a direction of the first polarization, and is also different from a direction of the second polarization.

24. A coupling device facilitating communication between a hearing aid and a communication device, the coupling device comprising:

a first antenna having a first polarization and configured to communicate with the hearing aid;

a second antenna having a second polarization and configured to communicate with the communication device; and at least one parasitic antenna element, wherein the at least one parasitic element has a third polarization, the at least one parasitic element configured to provide some isolation between the first antenna and the second antenna;

wherein the first antenna, the second antenna, and the at least one parasitic antenna element are coupled to a supporting structure, the supporting structure having a first surface and a second surface opposite from the first surface, the supporting structure having a first side, a second side shorter than the first side, a third side opposite from the first side, and a fourth side opposite from the second side, wherein the supporting structure comprises an elongated substrate, wherein the supporting structure comprises a ground plane and the first antenna is connected to the ground plane;

wherein (1) an entirety of the at least one parasitic antenna element, and (2) the second antenna, are both closer to the second side than to the fourth side, wherein the first antenna is closer to the fourth side than to the second side, wherein the at least one parasitic antenna element is closer to the first side than to the third side, and wherein the second antenna is closer to the third side than to the first side;

wherein the at least one parasitic antenna element is located closer to the second antenna than to the first antenna; and wherein a direction of the third polarization is different from a direction of the first polarization, and is also different from a direction of the second polarization.

25. The coupling device according to claim 24, wherein the entirety of the at least one parasitic antenna element located away from all space that is between the first antenna and the second antenna.

26. The coupling device according to claim 24, wherein the at least one parasitic antenna element and the first antenna are separated by a spacing, wherein the entirety of the at least one parasitic antenna element and an entirety of the first antenna are on opposite sides of the spacing, and wherein the at least one parasitic antenna element, the first antenna, and the spacing are at different respective longitudinal positions with respect to a longitudinal axis of the elongated substrate.

* * * * *